United States Patent [19]

Yan

[11] Patent Number: 4,478,709

[45] Date of Patent: Oct. 23, 1984

[54] PROCESS FOR STABILIZING DEWAXED DISTILLATE OILS

[75] Inventor: Tsoung-Yuan Yan, Philadelphia, Pa.

[73] Assignee: Mobil Oil Corporation, New York, N.Y.

[21] Appl. No.: 297,306

[22] Filed: Aug. 28, 1981

[51] Int. Cl.[3] ..... C10G 69/00; C10G 55/06; C10G 69/06

[52] U.S. Cl. ..... 208/257; 208/255; 208/60; 208/70

[58] Field of Search ..... 208/67, 95, 71, 98, 208/99, 260, 261, 257, 15, 18, 27, 28, 134, 135, 138, 70, 255, 60; 585/255, 258, 330, 500, 519, 533

[56] References Cited

U.S. PATENT DOCUMENTS

| | | | |
|---|---|---|---|
| 3,755,143 | 8/1973 | Hosoi et al. | 208/67 |
| 3,928,171 | 12/1975 | Yan et al. | 208/18 |
| 3,956,102 | 5/1976 | Chen et al. | 208/93 |
| 4,178,228 | 12/1979 | Chang | 208/67 |
| 4,181,597 | 1/1980 | Yan et al. | 208/58 X |
| 4,208,268 | 6/1980 | Sato et al. | 208/257 |
| 4,211,640 | 7/1980 | Garwood et al. | 208/255 |
| 4,361,477 | 11/1982 | Miller | 208/67 |
| 4,443,327 | 4/1984 | Shihabi et al. | 208/97 |

FOREIGN PATENT DOCUMENTS

| | | | |
|---|---|---|---|
| 49-34903 | 3/1974 | Japan | 208/67 |
| 52-24240 | 6/1977 | Japan | 208/67 |

*Primary Examiner*—Delbert E. Gantz
*Assistant Examiner*—Lance Johnson
*Attorney, Agent, or Firm*—Michael G. Gilman; Charles J. Speciale; Laurence P. Hobbes

[57] ABSTRACT

A method for reducing the pour point of a hydrocarbon oil which comprises contacting said oil under dewaxing conditions with a zeolite dewaxing catalyst thereby forming a dewaxed oil that contains olefins, and contacting said dewaxed oil and said contained olefins with a solid acidic catalyst under conditions effective to increase the stability of said oil.

16 Claims, 1 Drawing Figure

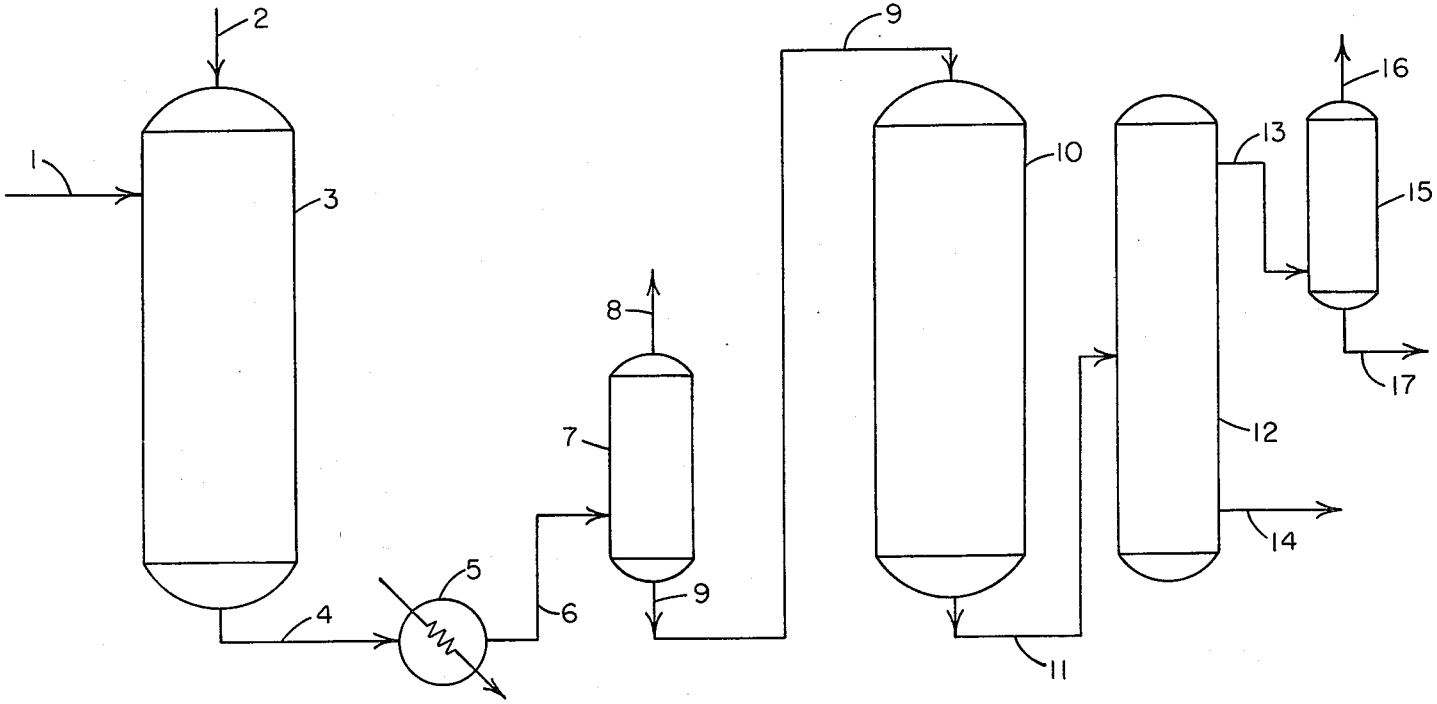
1
2
3
4
5
6
7
8
9
9
10
11
12
13
14
15
16
17

PROCESS FOR STABILIZING DEWAXED DISTILLATE OILS

BACKGROUND OF THE INVENTION

1. Field of the Invention

This invention pertains to dewaxing hydrocarbon oils. In particular, it pertains to a method for producing catalytically dewaxed distillate fuel oils with a reduced tendency to form sludge on storage.

2. Prior Art

It is generally known that distillate fuel oils prepared from waxy petroleum crudes will tend to have pour points in excess of 20° F., and that therefore the utility of such distillate fuels is severely limited to environments in which the oil does not lose fluidity. Also, because distillate fuels often are stored for protracted periods of time by both the refiner and the user, it is very desirable that the oil be resistant to the formation of sludge on storage. Good storage stability is particularly important in avoiding excessive maintenance of equipment with oils intended for use as home heating oils or as diesel fuel for the smaller diesel engines.

A process for catalytically dewaxing hydrocarbon oils by selectively cracking the waxy paraffins has recently become known. For example, a process of this nature which employs a mordenite catalyst associated with a hydrogenation component is described in the *Oil and Gas Journal,* dated Jan. 6, 1975, at pages 69–73. See also U.S. Pat. No. 3,668,113. Another process which utilizes a novel class of synthetic catalysts exemplified by ZSM-5 is described in U.S. Pat. No. Re. 28,398 to Chen et al. This Reissue patent discloses catalytic dewaxing to reduce the pour point not only of distillate oils but also of whole crudes, reduced crudes and syncrudes such as those syncrudes derived from shale. U.S. Pat. No. 3,956,102 and U.S. Pat. No. 4,067,797, both to Chen et al, describe catalytic dewaxing of a distillate oil which has been separated into a low pour point fraction and a high pour point fraction prior to dewaxing, followed by a recombination of the fractions. Of particular interest, as will be more fully explained hereinunder, is the disclosure that although hydrogen gas is used in the catalytic dewaxing step, the dewaxing process described in these last two patents does not consume hydrogen. It is further shown that the wax which is converted produces a light fraction, most of which is in the $C_4$ to 330° F. boiling range, and very little dry gas. The patents cited above are incorporated herein by reference.

Other patents on catalytic dewaxing also have been issued, including U.S. Pat. Nos. 3,894,938 to Gorring et al; 3,852,189 to Chen et al; 3,968,024 to Gorring; 3,980,550 to Gorring et al; 3,891,540 to Danniel et al; 3,893,906 to Garwood et al; 3,894,931 to Nace et al; 3,894,933 to Owen et al; 3,894,939 to Garwood et al; 3,926,782 to Plank et al; 4,044,064 to Milstein et al; 4,071,574 to Milstein et al; 4,059,648 to Derr et al; and, 4,080,397 to Derr et al. None of the above are believed to disclose or to suggest the present invention.

A method for stabilizing hydrocracked lubricating oils against light instability by treating the oils with olefins and acidic catalysts is described in *I&EC PRODUCT RESEARCH & DEVELOPMENT,* Volume 17, page 366, December 1978. U.S. Pat. Nos. 3,928,171 and 3,883,416, both to Yan et al, also describe a method for increasing the thermal and light stability and reducing the tendency toward sludge formation in a normally susceptible hydrocarbon oil having a boiling point in excess of 500° F. by treatment with a stabilizing agent in the presence of an acidic catalyst. This publication and patents also are incorporated herein by reference as if fully set forth.

It is an object of this invention to provide an improved process for the manufacture of low pour point distillate fuel oils from waxy crudes. It is a further object of this invention to provide a process for catalytically dewaxing a distillate hydrocarbon oil whereby forming low pour point oils have a reduced tendency to form sludge on storage. These and other objects will become apparent to one skilled in the art on reading this entire specification, including the appended claims.

BRIEF SUMMARY OF THE INVENTION

In the method of this invention, a catalytically dewaxed oil and an olefin having at least 4 carbon atoms are contacted with an acidic heterogenous catalyst more fully described hereinbelow at a temperature of about 300° to 500° F., a pressure of about 50 to 500 psig, and at a liquid hourly space velocity of about 0.25 to 5.0 LHSV, to form a dewaxed oil with markedly reduced tendency to deposit sludge on storage as evidenced by an accelerated storage test such as the ASTM-D2274 Distillate Fuel Oil Stability Test. All references herein to ASTM methods refer to the methods described in the current edition of volumes 23, 24 and 25 of "ASTM Standards", published by the American Society for Testing and Materials, Philadelphia, Pa.

There is a particularly advantageous embodiment of this invention in which no olefin need be added. In this embodiment the catalytic dewaxing is conducted with a zeolite catalyst in the cracking mode, i.e., the wax is converted by cracking which produces lower molecular weight olefins and paraffins rather than by hydrocracking which produces essentially no olefins. Stabilization against sludge formation is accomplished simply by passing the entire liquid effluent, including by-product olefinic gasoline, from the catalytic dewaxer to the acidic heterogenous catalyst under the conditions described above prior to separation of the gasoline boiling range material.

BRIEF DESCRIPTION OF THE DRAWING

Illustrated is one preferred embodiment of the invention.

DETAILED DESCRIPTION OF THE INVENTION

As is disclosed in U.S. Pat No. Re. 28,398, catalytic dewaxing may be accomplished either by cracking selectively the waxy constituents in the feed or by hydrocracking these constituents. It is important for purposes of this invention to recognize the essential distinction between these two modes of operation. In the cracking mode, the high molecular weight waxy paraffins are broken down into lower molecular weight fragments, at least some of which are olefins. Hydrocracking may be regarded as essentially the same process for present purposes with the exception that the olefins are hydrogenated to paraffins. It is essential in the present invention that the dewaxing be conducted in the cracking mode, i.e., that a substantial fraction of the wax fragments be olefinic. This has nothing to do with whether or not hydrogen is employed in the dewaxing step. Hydrogen may be employed, for example, if no strong hydrogenation component such as platinum is associated with the catalyst. In general, for the present process, it is desirable to avoid associating the zeolite cracking dewaxing catalyst with platinum or palladium. Another criterion that may be employed to determine whether or not the dewaxing step is conducted in the cracking mode when hydrogen is used is the substantial absence of hydrogen consumption. However, depending on the particular feed and the amount of wax converted, there may be some hydrogen consumption without hydrogenation of all of the olefins, in which case the dewaxing for present purposes may still be considered to be in the cracking mode.

The preferred dewaxing catalyst is a member of a novel class of zeolites that exhibit unusual properties. These zeolites have a silica to alumina mol ratio of at least about 12 up to about 200, say about 12 to 100 and a Constraint Index of 1 to 12. This Constraint Index results from a crystal structure in which the zeolitic windows are sufficiently large to admit normal paraffins and paraffins containing a single methyl branch such as 3-methylpentane, but not large enough to admit molecules of larger critical diameter than 3-methylpentane.

Rather than attempt to judge from crystal structure whether or not a zeolite possesses the necessary constrained access to molecules larger than normal paraffins, a simple determination of the Constraint Index as herein defined may be made by passing continuously a mixture of an equal weight of normal hexane and 3-methylpentane over a small sample, approximately one gram or less, of zeolite at atmospheric pressure according to the procedure which is described by Frilette et al in the *Journal of Catalysis,* Volume 67, No. 1, pages 218–222 (1981), published by Academic Press, Inc. This description is herein incorporated by reference.

The Constraint Index approximates the ratio of the cracking rate constants for the two hydrocarbons. Zeolites suitable for the present invention are those having a Constraint Index of 1 to 12. Constraint Index (CI) values for some typical zeolites are:

| CAS | C.I. |
|---|---|
| ZSM-4 | 0.5 |
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| TMA Offretite | 3.7 |
| Beta | 0.6 |
| H-Zeolon (mordenite) | 0.4 |
| REY | 0.4 |
| Amorphous Silica-Alumina | 0.6 |
| Erionite | 38 |

The preferred zeolites for use as dewaxing catalysts are exemplified by ZSM-5, ZSM-11, ZSM-12, ZSM-23, ZSM-35, ZSM-38, and other similar materials. U.S. Pat. No. 3,702,886 describing and claiming ZSM-5 is incorporated herein by reference.

ZSM-11 is more particularly described in U.S. Pat. No. 3,709,979, the entire content of which is incorporated herein by reference.

ZSM-12 is more particularly described in U.S. Pat. No. 3,832,449, the entire content of which is incorporated herein by reference.

ZSM-23 is more particularly described in U.S. Pat. No. 4,076,842, the entire content of which is incorporated herein by reference.

ZSM-35 is more particularly described in U.S. Pat. No. 4,016,245, the entire content of which is incorporated herein by reference.

ZSM-38 is more particularly described in U.S. Pat. No. 4,046,859, the entire content of which is incorporated herein by reference.

Of the foregoing, particularly preferred for the process of the present invention are ZSM-5 and ZSM-11. The method of preparing these zeolites prior to use as catalyst is known and does not constitute part of this invention. The description contained in U.S. Pat. No. 4,269,695 is illustrative and that description is herein incorporated by reference as if fully set forth.

With the preferred dewaxing catalyst, dewaxing of a suitable charge stock is conducted in the presence of hydrogen gas at a temperature of about 525° to about 800° F., at a pressure of about 50 to 500 psig, and at a liquid hourly space velocity of about 0.25 to 5.0. One skilled in the art will recognize, of course, that the specific conditions chosen within these ranges will depend on the feed and on the amount of conversion of waxy components that is required to produce the desired pour point.

The feed to the process of this invention is any hydrocarbonaceous oil in the distillate boiling range, exemplified for example, by an oil that has a 5 volume percent temperature less than 370° F. and a 90 volume percent distilled temperature less than about 800° F., as determined by an accepted distillation technique such as ASTM-D86, and that has an undesirably high pour point, usually greater than about 20° F.

When an oil such as the foregoing is catalytically dewaxed in the cracking mode, at least a part of the wax is broken down to an olefinic naphtha in the gasoline boiling range; that is, in the range of $C_{4+}$ to about 330° F.

In a preferred and particularly advantageous embodiment of the present invention, the dewaxed oil, together with the olefinic gasoline fraction contained therein, is passed to a catalytic stabilizing unit that contains as stabilizing catalyst a heterogenous acidic, porous solid. The classes of suitable catalysts that may be used include porous acidic organic resins, and porous acidic inorganic solids such as clays, crystalline aluminosilicates, such as zeolites and other acidic oxides. Some of these catalysts are described in detail in U.S. Pat. No. 3,928,171 at column 5, and this catalyst description is incorporated herein by reference as if fully set forth. A particularly preferred catalyst is a commercially manufactured acidic montmorillonite, designated as K306, manufactured by Chemitron. This catalyst is preferred because it is highly effective and inexpensive. Furthermore, it has been found to be effective even after long times on stream.

After the catalytic stabilization step, the dewaxed oil may be distilled to remove the gasoline boiling range fraction.

Referring now to the drawing, the waxy feed is passed via line 1, together with gaseous hydrogen introduced via line 2, to the catalytic dewaxing section 3 which contains a zeolite dewaxing catalyst. In section 3, at least some of the wax is converted to olefinic naphtha in the gasoline boiling range, and the total mixture including hydrogen is passed from section 3 via line 4, to heat exchanger 5 wherein the temperature is reduced to about 300° to 500° F. The total cooled mixture is passed via line 6 to flash separator 7 which separates hydrogen and dry gas from the remainder of the liquid mixture. Hydrogen and dry gas are removed via line 8, and the liquid mixture is passed via line 9 to a catalytic stabilization unit 10 that contains the heterogeneous acidic stabilizing catalyst. The catalytically stabilized mixture formed in unit 10 passes via line 11 to distillation section 12. A gasoline fraction is removed from the distillation section via line 13, and passed to stabilizer 15 which separates the gasoline into stabilized gasoline which is removed via line 17 to $C_3$ to $C_4$ gases which are removed via line 16. The low pour point, catalytically stabilized distillate oil is recovered from distillation tower 12 via line 14.

As an optional arrangement for the equipment shown in the drawing, the flash drum 7 which is shown located downstream of heat exchanger 5 and before the catalytic stabilization unit 10, may instead be located immediately downstream of the catalytic stabilization unit 10, with the oil discharged from the flash drum being passed to distillation section 12. Which option is more suitable to producing oil with the highest stability will depend on the nature of the feed, the extent of wax cracking, and especially the temperature selected for operation of the flash drum.

It will be understood by those skilled in the art that the arrangement of apparatus shown in the drawing is illustrative and is not to be construed as limiting the scope of this invention, said scope being determined by this entire specification, including the claims appended thereto.

What is claimed is:

1. A method for producing a stabilized hydrocarbon distillate oil which method comprises contacting an unstable distillate oil and a stabilizing amount of an olefinic naphtha in the gasoline boiling range which contains olefin having at least 4 carbon atoms, with an acidic porous solid stabilization catalyst at a temperature of about 300° to 500° F., a pressure of about 50 to 500 psig, and a liquid hourly space velocity of about 0.25 to 5.0 LHSV, provided that wherein said olefinic naphtha is obtained by catalytically dewaxing a wax-containing distillate oil by contacting said oil with a zeolite dewaxing catalyst, said zeolite dewaxing catalyst has a silica to alumina mole ratio ranging from about 12 to 200.

2. The method of claim 1 wherein said silica to alumina mole ratio ranges from about 12 to 100.

3. The method described in claim 1 wherein said stabilization catalyst comprises montmorillonite.

4. The method described in claim 1 including the step of removing said olefinic naphtha from said stabilized distillate oil.

5. The method described in claim 1 wherein said olefin is a straight chain olefin and including the step of removing said olefinic naphtha from said stabilized oil.

6. The method of claim 1 wherein said olefinic naphtha is obtained by catalytically dewaxing a wax-containing distillate oil by contacting said oil with a zeolite dewaxing catalyst under conditions effective to convert at least some of said wax to olefinic naphtha in the gasoline boiling range to produce a dewaxed distillate oil containing olefinic naphtha.

7. The method of claim 6 wherein said unstable distillate oil is said dewaxed distillate oil.

8. The method described in claim 7 wherein said dewaxing is conducted at a temperature of 525° to 800° F.

9. The method of claim 6 wherein said dewaxed distillate oil containing olefinic naphtha is stabilized by contacting with said acidic porous solid stabilization catalyst.

10. The method described in claim 9 wherein said zeolite dewaxing catalyst is ZSM-5 or ZSM-11.

11. The method described in claim 9 wherein said dewaxing is conducted at a temperature of 525° to 800° F.

12. The method described in claim 6 wherein said zeolite dewaxing catalyst is ZSM-5 or ZSM-11.

13. The method described in claim 12 wherein said dewaxing is conducted in the presence of hydrogen gas.

14. The method described in claim 6 wherein said dewaxing is conducted in the presence of hydrogen gas.

15. The method described in claim 6 wherein said dewaxing is conducted at a temperature of 525° to 800° F.

16. The method described in claim 6 wherein said dewaxing is conducted at a temperature of 525° to 800° F.

* * * * *